US007464633B1

(12) United States Patent
Kao

(10) Patent No.: US 7,464,633 B1
(45) Date of Patent: Dec. 16, 2008

(54) STRAND CARRIER FOR BRAIDING APPARATUS

(76) Inventor: Kung-Pao Kao, Rm1, 12F, No. 50 Lane 22, Chung-ai Road, Zuoying District, Kaohsiung City 813 (TW)

( * ) Notice: Subject to any disclaimer, the term of this patent is extended or adjusted under 35 U.S.C. 154(b) by 0 days.

(21) Appl. No.: 11/941,933

(22) Filed: Nov. 17, 2007

(51) Int. Cl.
*D04C 3/16* (2006.01)

(52) U.S. Cl. ..... 87/55; 87/56

(58) Field of Classification Search ..... 87/55–57, 87/61

See application file for complete search history.

(56) References Cited

U.S. PATENT DOCUMENTS 3,276,310 A * 10/1966 Radlauer ..... 87/22
3,686,997 A * 8/1972 Strangfeld et al. ..... 87/57
4,719,838 A * 1/1988 DeYoung ..... 87/57
4,827,707 A * 5/1989 Zoulek ..... 87/57
6,450,078 B1 * 9/2002 Frank et al. ..... 87/55
6,810,785 B2 * 11/2004 Chen ..... 87/56

* cited by examiner

*Primary Examiner*—Shaun R Hurley
(74) *Attorney, Agent, or Firm*—Banger Shia

(57) ABSTRACT

The present invention pertains to a strand carrier for braiding apparatus providing with a strand supplier on a main board which comprises a strand bobbin with strand threaded thereon and a braid controlling mechanism for driving a rotation of the bobbin. Also, by means of a gear pulley disposed on the bobbin and the braid controlling mechanism including a latch portion and an adjusting portion, a certain amount of tensioning happens to the strands for driving the expeditious movement of the adjusting portion and furthering the latch portion to be away from the gear pulley. In this manner, the present invention prevents the latch portion from randomly moving its pawl away from the gear pulley while being subjected to an inappropriate pulling and smoothly draws the strands for interlacing them into a braiding fabric, thus increasing the braiding efficiency and quality.

3 Claims, 5 Drawing Sheets

STRAND CARRIER FOR BRAIDING APPARATUS

BACKGROUND OF THE INVENTION

1. Field of the Invention

The present invention relates to a strand carrier, particularly to a strand carrier for braiding apparatus.

2. Description of the Related Art

Referring to FIGS. 1 and 2, a conventional strand carrier comprises a strand base 11 with an upper base 111 and a lower base 112, two retainers 113 disposed within the lower base 112, a board 12 attached to the upper base 111, a strand stem 13 coupled to the board 12, and a strand supplier 14 operatively mounted to the board 12; wherein, the lower base 112 provides with two parallel openings 114, and each of which consists of a retaining plate 115 and a guiding tab 116 extended outward from the opening 114; further, the guiding tab 116 is inclined to the opening 114 by an angle "θ1". The strand stem 13 has a strand pulley 131 and a guiding hole 132 pivotally disposed thereon.

Still, the strand supplier 14 has a spool 141 with strands 2 threaded thereon, and a braid controlling device 15 disposed on the board 12 for adjusting a rotation of the spool 141; wherein, a gear pulley 142 attaches to one side of the spool 141, and the device 15 includes an adjusting lever 151 pivoted to the board 12, a spring 152 mounted in the strand stem 13, a rod 153 with one side thereof disposed in the strand stem 13 for being propelled by the spring 152 and the lever 151, and two ancillary strand pulleys 154 mounted on both sides of the adjusting lever 151.

In manipulation, the strand carrier 1 is mounted on a braiding machine and the machine here is omitted in the figures; further, the adjusting lever 151 with its pawl is inserted into the gear pulley 142 by the pressing of the rod 153 as shown in FIG. 3. Also, the strand 2 supplied from the strand supplier 14, thence to and around the ancillary strand pulleys 154 and the strand pulley 131, and then through the guiding hole 132. While braiding, the guiding tab 116 moves along a "8" track on the braiding machine to tension the strand 2, which rotates the ancillary strand pulleys 154 and further raises the adjusting lever 151. Thus, the lever 151 has its pawl to move away from the gear pulley 142 as shown in FIG. 4 and the spool 141 remains rotating to free the strand 2. Relatively, a certain amount of slack is also produced in the strand 2 while moving along the track, and the spring 152 forces the rod 153 to press the lever 151 back to the gear pulley 142 so as to pause drawing the strand 2.

However, due to a higher braiding speed and that the strand 2 facilely drives the lever 151 up while the guiding tab 116 shuttles on the braiding machine, the lever 151 can not precisely have its pawl to be interposed between the gear pulley 142 in time of a continuous pulling by the machine, which results of the strand 2 being incessantly drawn out or even being snapped under the tension, thus the strand 2 can not be smoothly interlaced into a fabric and which affects the braiding efficiency and quality.

SUMMARY OF THE INVENTION

Therefore, the object of the present invention is to provide a strand carrier for braiding apparatus, which facilitates to properly and smoothly transport the strands of the strand bobbin and achieves a better braiding efficiency and quality.

The strand carrier in accordance with the present invention mainly comprises a strand base, two retainers, a strand stem, and a strand supplier; wherein, the strand supplier has a strand bobbin with strands threaded thereon, and a braid controlling mechanism disposed adjacent thereto for adjusting a rotation of the strand bobbin. Particularly in that the braid controlling mechanism comprises a latch portion and an adjusting portion respectively pivoted to the main board, a spring and a rod mounted in the strand stem for interacting with each other, and a tensioning member with both sides thereof attached to the main board and the adjusting portion. Thereupon, the adjusting portion is adapted to the inappropriate tension and slack of the strands and prevents from facilely driving the latch portion away from the gear pulley to result in randomly furthering the bobbin rotating, thereby effectively control the transport of the strands.

The advantages of the present invention over the known prior arts will become more apparent to those of ordinary skilled in the art upon reading the following descriptions in junction with the accompanying drawings.

DETAILED DESCRIPTION OF THE PREFERRED EMBODIMENTS

Figure 1:
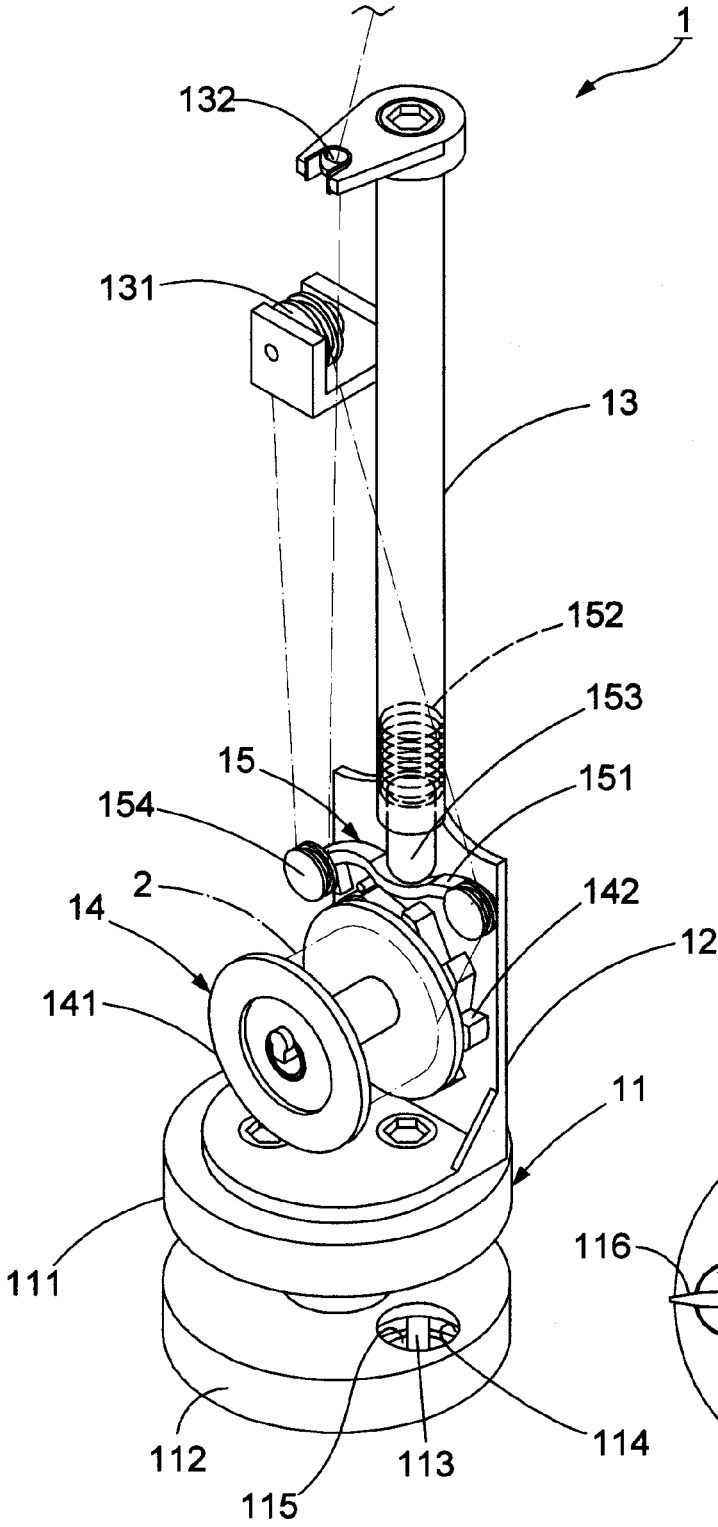
FIG. 1 FIG. 2 (PRIOR ART)
FIG. 1 is a perspective view showing a conventional invention.
Figure 2:
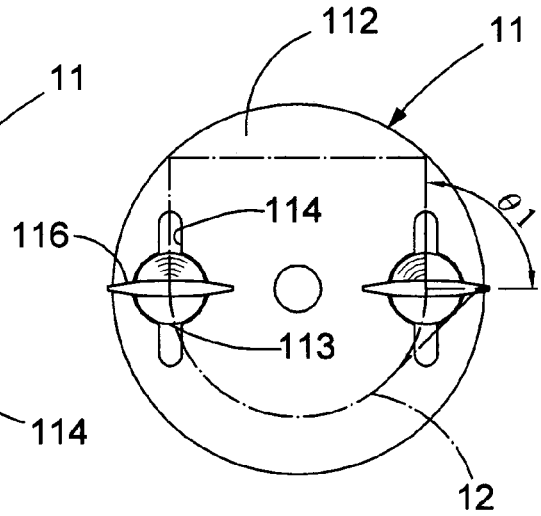
FIG. 1 FIG. 2 (PRIOR ART)
FIG. 2 is a bottom view of FIG. 1.
Figure 3:
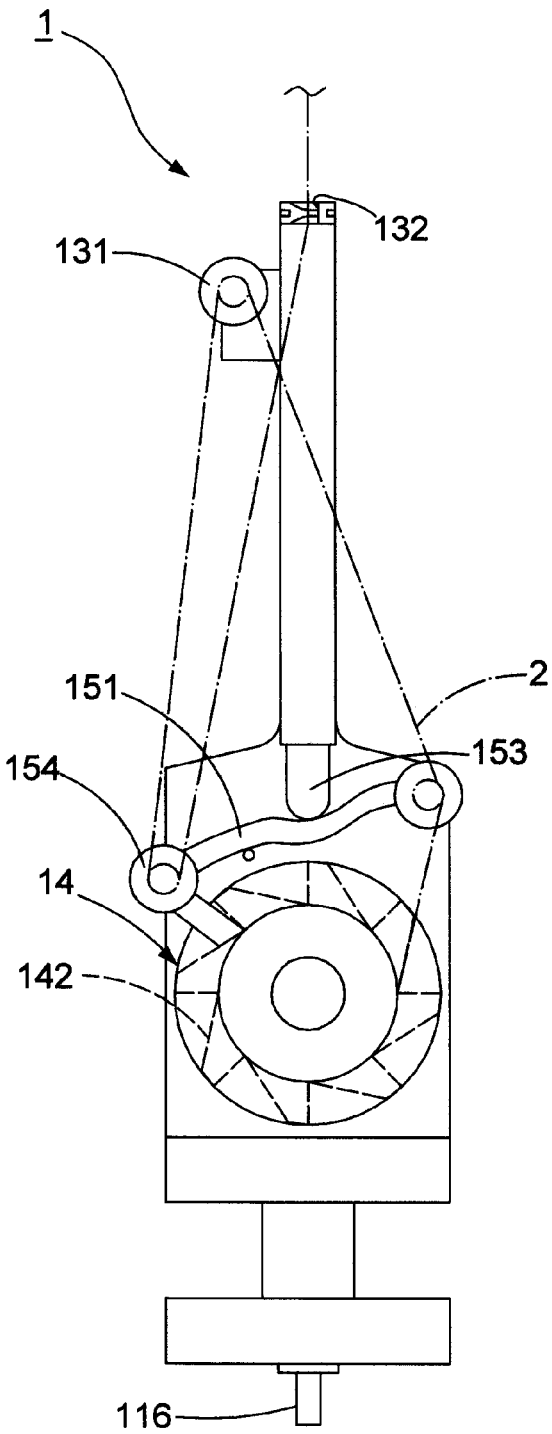
FIGS. 3 and 4 are schematic views showing the conventional invention of FIG. 1 in braiding states.
Figure 4:
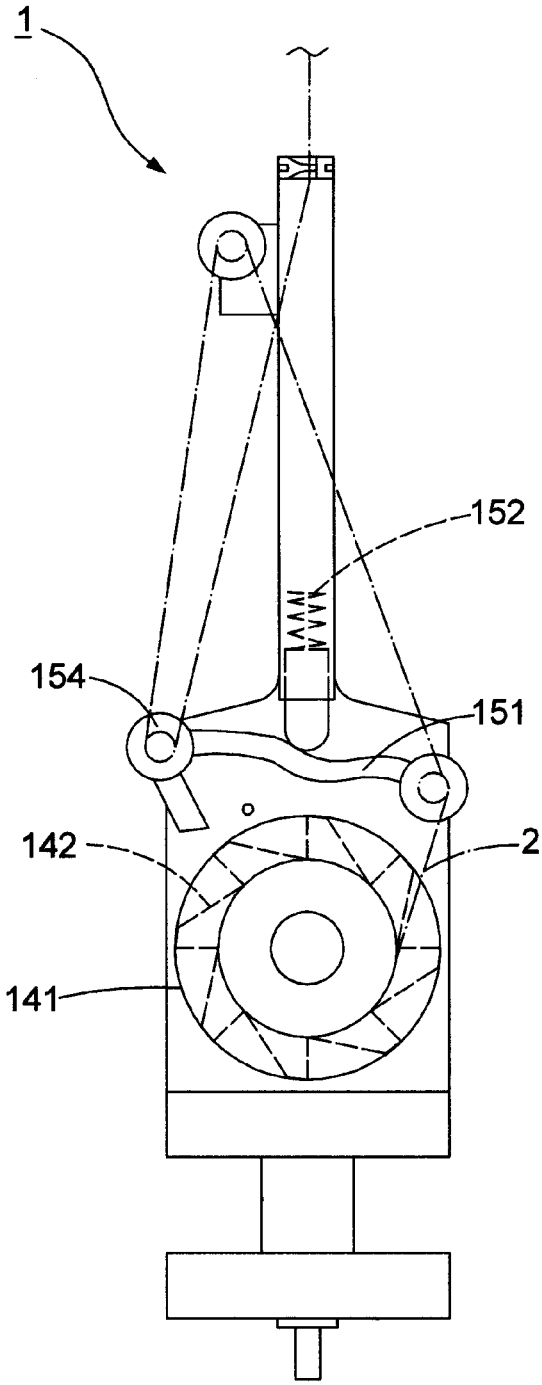
FIG. 4 (PRIOR ART)

Before the present invention is described in greater detail, it should be noted that the like elements are denoted by the similar reference numerals throughout the disclosure.

Figure 5:
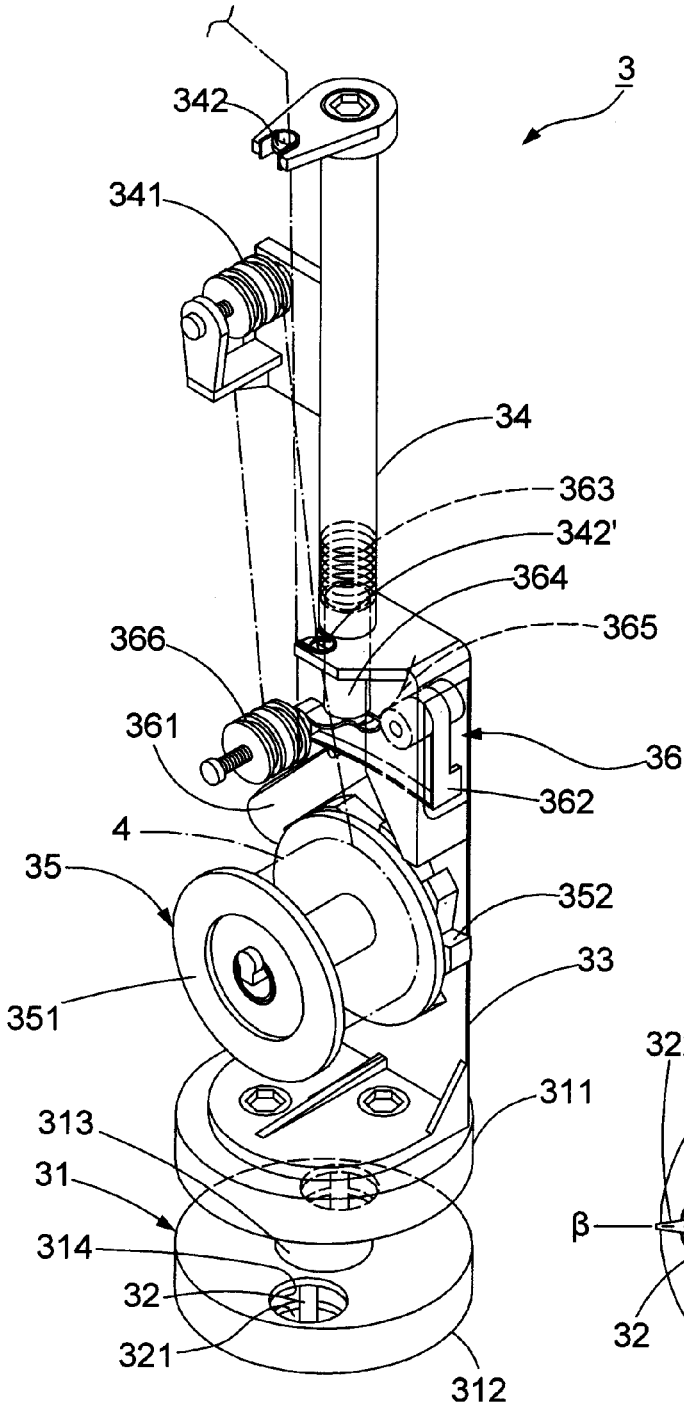
FIG. 5 is a front perspective view of showing a preferred embodiment of the present invention.

Referring to FIG. 5, a strand carrier 3 for braiding apparatus of the present invention comprises a strand base 31, two retainers 32, a main board 33, a strand stem 34, and a strand supplier 35; wherein, the strand base 31 has an upper base 311, a lower base 312, and a shaft 313 located therebetween for coupling the two bases 311-312; the lower base 312 provides with two parallel openings 314 arranged thereon. Further, located within each of the two openings 314 is the retainer 32 consisting of a retaining plate 321 and a guiding tab 322 extended outwardly from the opening 314, and the guiding tab 322 is inclined with respect to the opening 314 by an angle "θ1" (precisely shown in FIG. 6). In addition, the main board 33 is positioned to be inclined to an imaginary line "β" formed through passing the centers of the above two openings 214 by an included angle "θ2", and it preferably has the included angle of 45 degrees in the preferred embodiment of the present invention. The strand stem 34 is coupled to the main board 33 and comprises at least one strand guiding pulley 341 and at least one strand guiding hole 342 pivoted thereto, and here two strand guiding pulleys 341 and strand guiding holes 342-342' are adopted as shown in FIG. 5.

Continuing with the aforementioned, the strand supplier 35 is operatively mounted at one side of the main board 33 and includes a strand bobbin 351 with strands 4 threaded thereon, and a braid controlling mechanism 36 is disposed adjacent to the strand supplier 35 for adjusting a rotation of the strand bobbin 351. Further, the strand 4 supplied from the strand bobbin 351 passes around the strand guiding pulley 341 and through the strand guiding holes 342-342', and a gear pulley 352 is affixed to the strand bobbin 351, either at one side or both sides thereof. Moreover, the braid controlling mechanism 36 including a latch portion 361 and an adjusting portion 362 pivoted to the main board 33 in sequence, a spring 363 mounted within the strand stem 34, a rod 364 with one side thereof disposed in the strand stem 34 for being boosted toward the spring 363 and sprung back toward the adjusting portion 362, and a tensioning member 365 with both sides thereof respectively attached to the main board 33 and the adjusting portion 362 so that the adjusting portion 362 gives a rising of the latch portion 361, and also the rod 364 propels a descending thereof for which to be interposed between the gear pulley 352. At least one ancillary strand pulley 366 is pivotally mounted to one side of the adjusting member 362, and simultaneously it is adopted to have two ancillary strand pulleys 366 in the preferred embodiment.

Figure 6:
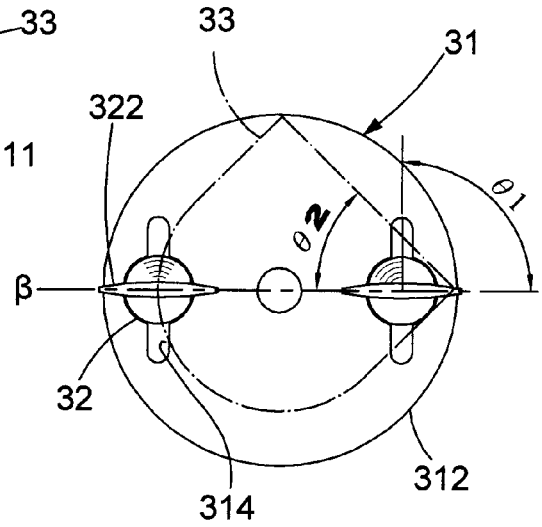
FIG. 6 is a bottom view of FIG. 5.

As referring to FIGS. 5 and 6, due to the main board 33 being positioned to be inclined to the imaginary line "β" at an included angle "θ2" of 45 degrees, the strand carrier 3 is freely mounted on the braiding machine without concerning about the inappropriate mounting orientation of the carrier which may affect the output of the strand 4 (the machine is omitted in the figures). Further referring to FIG. 8, initially, the strand 4 supplied from the strand bobbin 351 sequentially passes through the strand guiding hole 342', thence to and around the strand guiding pulley 341 and the ancillary strand pulley 366, and further goes through the strand guiding hole 342. A plurality of strands 4 can also be arranged at the same time around the strand guiding pulleys 341 and ancillary strand pulleys 366.

Figure 7:
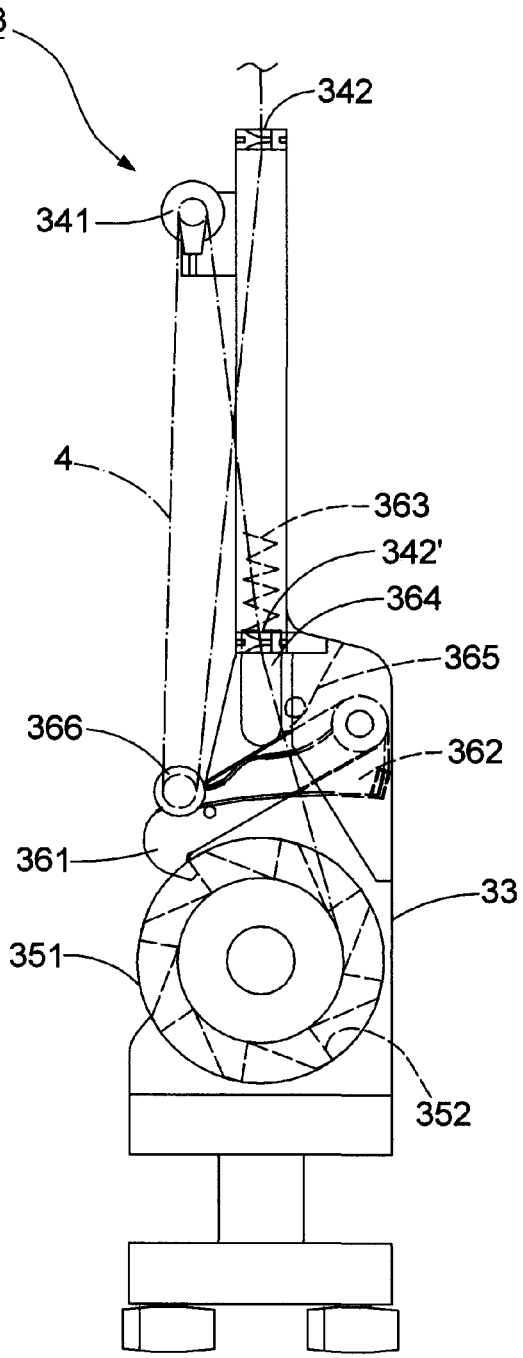
FIGS. 7, 8, and 9 are schematic views showing the preferred embodiment of FIG. 5 in braiding states.
Figure 8:
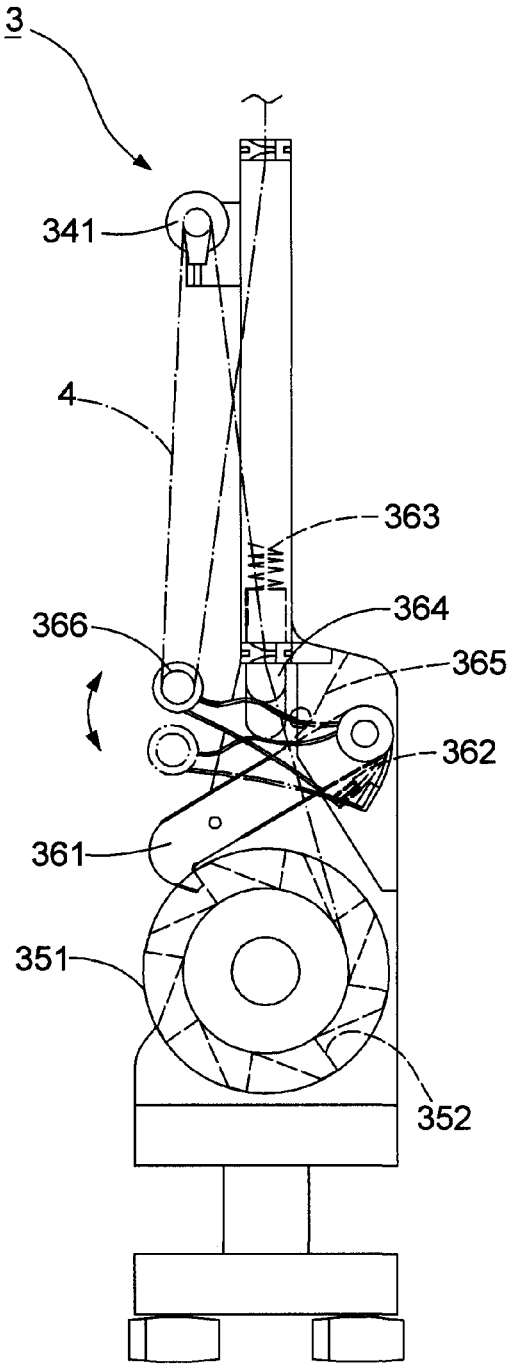
Figure 9:
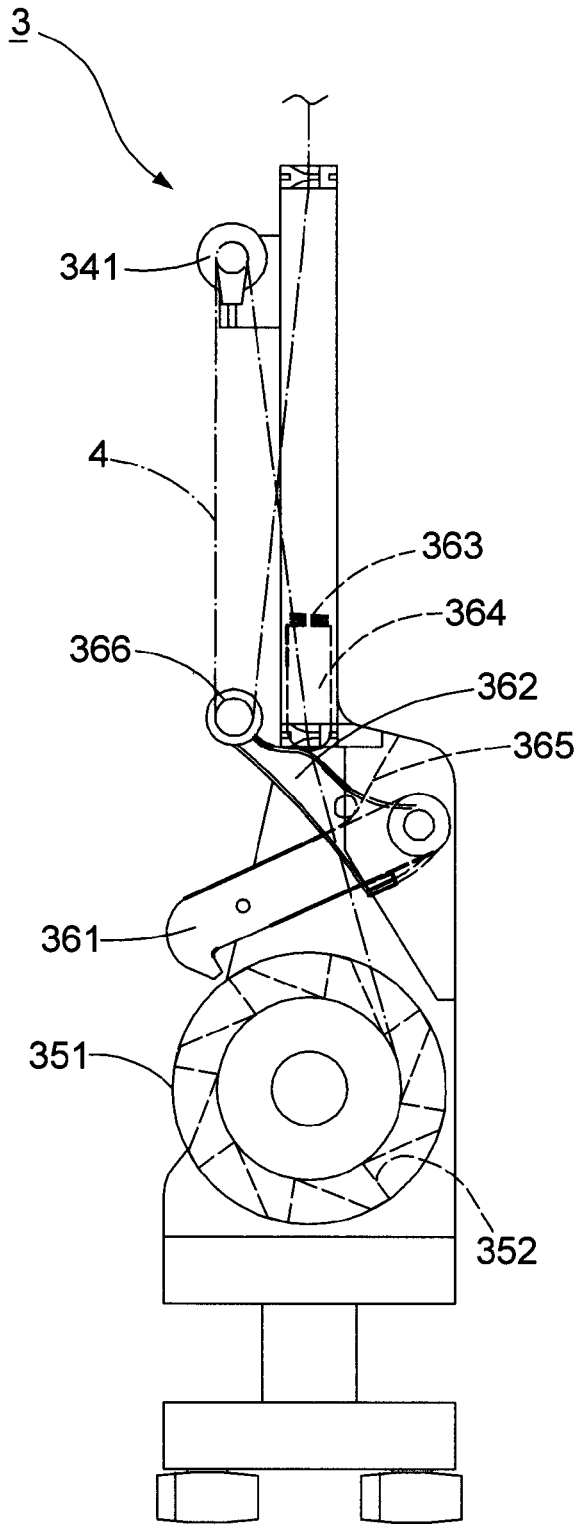

While operating, as shown from FIG. 7 to FIG. 9, while the strand carrier 3 shuttles along a "8" track on the coaxial braiding machine (not shown), a certain amount of tensioning from the braiding machine gradually produces in strand 4, which stimulates the adjusting portion 362 to have an incessantly upward and downward movement as arrowed in FIG. 8. In this manner, the latch portion 361 may still retain its pawl to be interposed between the gear pulley 352. Thereafter, the latch portion 361 with its pawl in FIG. 9 is wholly raised up to be away from the gear pulley 352 until the tensioning of the strand 4 exceeds the resilience of the spring 363 to entirely boost the rods 364 up; simultaneously the strand bobbin 351 thus begins to rotate and free the strand 4 for braiding.

Relatively, when the strand carrier 3 moves again along the meandering track of the braiding machine (not shown), a certain amount of slack also happens to the strand 4 and renders the ancillary strand pulley 366 to be descended. The rod 364 gradually returns back by the pushing of the spring 363 and further presses downwardly toward the adjusting portion 362, with the result that the slack of tensioning member 365 interacts between the adjusting portion 362 and the latch portion 361 and makes them move downwardly (seen from FIGS. 9 to 8). The strand bobbin 351 and the strand 4 would stop operating until the latch portion 361 wholly inserts its pawl into the gear pulley 352 (as shown in FIG. 7). Thereupon, the bobbin 351 would not be facilely rotate to transport the strand 4 unless the strand 4 is tense enough to boost the rod 364 up and compress the spring 363 for entirely raising up the adjusting portion 362 and the latch portion 361.

To sum up, the present invention takes advantages of the braid controlling mechanism providing with the interactive elements. That is, there is a buffer for the adjusting portion to make the latch portion not be easily away from the gear pulley in time of shuttling along the machine and of being subjected to the tensioning of the stands; oppositely, the latch portion can also be gradually returned back to the gear pulley through the adjusting portion driven by the cooperation of the spring and the rod. Therefore, the strands would be adjustably drawn out by means of the upward and downward movements of the adjusting portion although the braiding machine generates an inappropriate amount of tensioning and slack in the strands while operating, thereby smoothly interlacing the strands into a braiding fabric and increasing the braiding efficiency.

While we have shown and described the embodiment in accordance with the present invention, it should be clear to those skilled in the art that further embodiments may be made without departing from the scope of the present invention.

I claim:

1. A strand carrier for braiding apparatus comprising:

a strand base consisting of an upper base, a lower base, and a shaft disposed therebetween, by which said upper base is coupled to said lower base; wherein, said lower base providing with two parallel openings disposed thereon;

two retainers separately disposed in said two openings, and each of which comprising a retaining plate mounted in said opening and a guiding tab affixed to said retaining plate and extended outwardly from said opening so as to render said guiding tab to be inclined with respect to said opening by an angle;

a main board longitudinally attached to said upper base of said strand base;

a strand stem coupled to said main board; wherein, said strand stem having at least one strand guiding pulley and at least one strand guiding hole pivotally mounted thereon; and a strand supplier operatively mounted at one side of said main board and having a strand bobbin with strands threaded thereon; a braid controlling mechanism disposed adjacent to said strand supplier for adjusting a rotation of said strand bobbin; wherein, said strands supplied from said strand bobbin passing around said strand guiding pulley and through said strand guiding hole; a gear pulley being affixed to said strand bobbin; said braid controlling mechanism including a latch portion and an adjusting portion respectively pivoted to said main board, a spring mounted in said strand stem, a rod with one end thereof disposed in said strand stem for interacting with said spring, and a tensioning member with both sides thereof respectively attached to said main board and said adjusting portion, so that said latch portion being raised up or being propelled to be interposed between said gear pulley by operatively moving said adjusting portion; said adjusting portion having at least one ancillary strand pulley pivoted to one side thereof.

2. The strand carrier as claimed in claim 1, wherein said main board is located to be inclined with respect to an imaginary line defined through passing centers of said two openings by an included angle.

3. The strand carrier as claimed in claim 2, wherein said included angle is preferably at 45 degrees.

* * * * *